US005885393A

United States Patent [19]

Mano et al.

[11] Patent Number: 5,885,393

[45] Date of Patent: Mar. 23, 1999

[54] SILVER HALIDE IMAGE WITH HEAT TRANSFER IMAGE AND METHOD OF FORMING

[75] Inventors: Shigeru Mano; Ichiroh Maeda; Shigeo Tanaka, all of Hino, Japan

[73] Assignee: Konica Corporation, Tokyo, Japan

[21] Appl. No.: 827,796

[22] Filed: Apr. 11, 1997

[30] Foreign Application Priority Data

Apr. 24, 1996 [JP] Japan ..... 8-102631

[51] Int. Cl.[6] ..... B44C 1/165

[52] U.S. Cl. ..... 156/230; 156/247; 156/235; 156/244.16; 430/230; 430/250

[58] Field of Search ..... 430/201, 230, 430/203, 215, 262, 263, 213, 941, 614, 615, 244, 251, 250, 233; 156/230, 277, 247, 235, 244.16, 272.2

[56] References Cited

U.S. PATENT DOCUMENTS 4,784,932 11/1988 Nakamura et al. ..... 430/203

5,236,805 8/1993 Idota et al. ..... 430/250

5,242,781 9/1993 Ohbayashi et al. ..... 430/203

*Primary Examiner*—Merrick Dixon

*Attorney, Agent, or Firm*—Frishauf, Holtz, Goodman, Langer & Chick, P.C.

[57] ABSTRACT

A method for forming images by providing a first image formed with silver halide photographic material which has been imagewise exposed and developed according to conventional photographic processes. Thereafter, forming a second image by imagewise transferring ink of a heat fusible thermal transfer ink sheet onto the first image. The surface layer of the ink contacting the layer having the first image contains a resin having a hydrophilic group, the color tone of the second image has the relationships in the CIE coordinate, $L^* \leqq 30$, $-5 \leqq a^* \leqq +5$ and $+0.1 \leqq b^* \leqq +50$, and glossiness measured according to JIS-Z8741-1983 is at least 100. The resulting image is a photographic image with a heat transfer image thereon.

13 Claims, 3 Drawing Sheets

SILVER HALIDE IMAGE WITH HEAT TRANSFER IMAGE AND METHOD OF FORMING

FIELD OF THE INVENTION

The present invention relates to a method for forming an image consisting of a heat fusible thermal transfer image and a high quality photographic image, the method providing an image with excellent sharpness and durability on a photographic component layer according to a heat fusible thermal transfer method by mating the photographic component layer property of a silver halide light sensitive material with a property of a heat fusible thermal transfer ink.

BACKGROUND OF THE INVENTION

Generally, photographic print paper is exposed through a negative image bearing film and through a transparent negative original for forming a character image and then developed to obtain a photographic print having a photographic continuous tone image and a character image. This transparent negative original is ordinarily prepared using a computer phototypesetting machine.

It takes time and also requires a special apparatus to prepare the transparent original using a computer phototypesetting machine. Therefore, it is practically impossible for individuals to print different characters on different photographic print paper or to print a character image on a photograph.

Recently, it has been possible for individuals to compose and edit a photographic continuous tone image and a character image on a terminal display using a computer and output edited images using an ink jet printer or a thermal transfer printer. Regarding the character image, particularly a heat fusible thermal transfer printer can provide a high quality character image with no contour blur, however, regarding photographic continuous tone images, there has not been proposed an output method to compare with that of a silver halide photographic process.

High quality photographic continuous tone images and character image can be easily obtained at low cost by combining a high quality image from a silver halide photographic process with a character image from a heat fusible thermal transfer process, however, adhesion between a heat fusible thermal transfer ink and a gelatin layer on the surface of a photographic print paper is poor, and the formed image is not durable enough. Further, in order to form a high quality metallic color image, particularly a gold image, using a heat fusible thermal transfer ink, better ink transferability is required, but conventional methods are insufficient to form such images.

SUMMARY OF THE INVENTION

The present invention has been made in view of the above.

An object of the present invention is to provide a method of forming an image comprising a heat fusible thermal transfer image with high image durability equivalent to that obtained in a photographic process and a high quality photographic continuous tone image according to a photographic process.

DETAILED DESCRIPTION OF THE INVENTION

Figure 1:
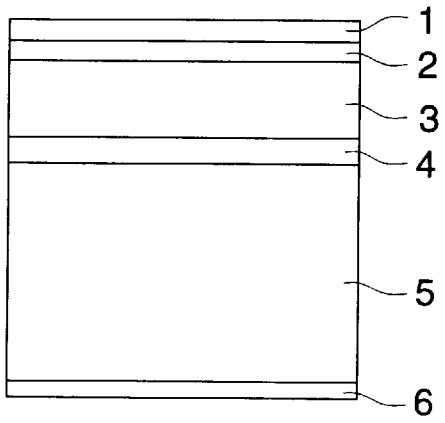
FIG. 1 shows a constitution of an ink sheet for heat fusible thermal transfer used in Example 1.

The above object of the invention can be attained by the following:

1. A method for forming an image comprising the steps of providing a first image formed photographic material which has been imagewise exposed and developed according to a conventional photographic process employing a silver halide photographic light sensitive material comprising a first reflective support and provided thereon, a photographic component layer comprising a silver halide emulsion layer, and imagewise transferring ink of a heat fusible thermal transfer ink sheet comprising a second support and provided thereon, the ink, onto the first image to form a second image, wherein the surface layer of the ink contacting the layer having the first image contains a resin having a hydrophilic group, the color tone of the second image has the relationships in the CIE coordinate, $L^* \leqq 30$, $-5 \leqq a^* \leqq +5$ and $+0.1 \leqq b^* \leqq +50$, and glossiness measured according to JIS-Z8741-1983 is 100 or more,
2. The method of item 1 above, wherein the resin content of the surface layer is 30% by weight or more,
3. The method of item 1 or 2 above, wherein the ink sheet has a releasing layer, a colorant layer, a metal film layer and an adhesive layer in that order on the second support,
4. The method of item 3 above, wherein the colorant layer contains a yellow colorant and the metal film layer is an aluminum film layer formed by evaporation,
5. The method of item 1, 2, 3 or 4 above, wherein the calcium content of the photographic component layer is 10 $mg/m^2$ or less, or
6. The method of item 1, 2, 3, 4 or 5 above, wherein an outermost layer of the photographic component layer contains gelatin having a difference of 50 or more between its specific rotation at 20° C. and its specific rotation at 40° C.

The present inventors have studied material or properties of the photographic component layer of a silver halide photographic light sensitive material and the material of an outermost layer of the heat fusible thermal transfer ink contacting the photographic component layer, and have attained the invention by mating the properties of both. According to the invention, the fusible thermal transfer image has a high durability and a high quality printed character image, equivalent to that obtained in a photographic process.

The present invention will be detailed below.

Silver Halide Photographic Light Sensitive Material

The silver halide photographic light sensitive material (hereinafter referred to also as a light sensitive material) in the invention has a photographic component layer comprising a light sensitive silver halide emulsion layer on a reflective support, and is imagewise exposed and developed according to a conventional photographic process to obtain a so-called photographic print. As a light sensitive material, any conventional material can be used, but the calcium content of the photographic component layer is preferably 10 $mg/m^2$ or less, and more preferably, an outermost layer of the photographic component layer preferably contains gelatin having a difference of 50 or more between its specific rotation at 20° C. and its specific rotation at 40° C., in mating the light sensitive material with properties of a heat fusible thermal transfer ink. The calcium content and gelatin will be detailed below.

(Calcium content)

The calcium content in the invention is represented by a calcium weight per $m^2$ of light sensitive material in terms of calcium atoms in a calcium compound such as a calcium salt. As a quantitative analysis, ICP (Inductively Conpied Plasma) emission spectrochemical analysis is used. This analysis is detailed in "Kagaku no Ryoiki", Zokan 127, published in 1980 by Nannkodo and V. A. Fassel, Anal. Chem., 46, 1110 (1974).

Gelatin used advantageously as a binder for light sensitive material ordinarily contains a calcium salt derived from raw material or through a manufacturing process in an amount of several thousand ppm in terms of a calcium atom. The light sensitive material practically used ordinarily contains 15 $mg/m^2$ or more of calcium in terms of calcium atoms.

The calcium content of the photographic component layer of the light sensitive material in the invention is preferably 10 $mg/m^2$ or less, and more preferably, 5 $mg/m^2$ or less.

In order to reduce the calcium content, gelatin having a low calcium content is used as a binder, or a coating solution to be coated on a support during light sensitive material manufacturing, a silver halide emulsion, a dispersion of a hydrophobic compound such as a coupler or a gelatin composition such as a gelatin solution is desalted by noodle washing, dialysis or ultrafiltration. Of these, gelatin having a low calcium content is preferably used.

(Gelatin)

In order to reduce the calcium content of gelatin, an ion exchange method is preferably used. In the ion exchange method, as described, for example, in Japanese Patent O.P.I. Publication Nos. 63-296035, the gelatin solution is passed through an ion exchange resin and is passed through a cation exchange resin particularly for reducing the calcium content, during manufacturing or employing of gelatin.

The gelatin having a low calcium content includes an acid processed gelatin in which incorporation of calcium in gelatin is small.

The gelatin used in the light sensitive material can be subjected to hydrogen peroxide oxidation treatment in order to reduce a photographic activity.

The specific rotation of gelatin in the invention means that of gelatin before hardening treatment, and is measured according to the following method.

A 1% aqueous gelatin solution, which is adjusted to pH 6.0, is prepared, and allowed to stand for 30 minutes at 40° C. Thereafter, specific rotation $[\alpha]^{40}$ of the resulting solution is measured employing a sodium lamp as a light source, and after the solution is allowed to stand for one hour at 20° C.±0.1° C., specific rotation $[\alpha]^{20}$ is similarly measured. The difference $\Delta\alpha$ between the specific rotation at 20° C. and the specific rotation at 40° C. is obtained by the following equation:

$$\Delta\alpha=[\alpha]^{20}-[\alpha]^{40}|$$

In the invention, $\Delta\alpha$ of gelatin used in light sensitive material is preferably 50 or more, more preferably 60 or more, and still more preferably 60 to 100. When gelatins are blended, $\Delta\alpha$ of the blended gelatin may be 50 or more.

Gelatin for photographic use includes and an alkali processed gelatin such as lime, an acid processed gelatin such as hydrochloric acid during manufacturing from collagen, and gelatin is generally made from pig skin, cow skin or cow bone.

Gelatin used in the light sensitive material in the invention may be a lime-processed gelatin or an acid processed gelatin and gelatin made from pig skin, cow skin or cow bone. Preferably, gelatin is a lime-processed gelatin made of cow bone.

(Heat fusible thermal transfer ink sheet)

The heat fusible thermal transfer ink sheet in the invention (hereinafter referred to also as ink sheet) comprises a support and provided thereon, a heat fusible thermal transfer ink (hereinafter referred to also simply as ink) whose surface layer contains a resin having a hydrophilic group. The ink sheet can form another image on an image formed after imagewise exposure and development of a silver halide photographic light sensitive material, and assure sharp and durable image.

The heat fusible thermal transfer ink or ink herein referred to is a layer for being transferred from the ink sheet to form another image to the image formed according to the conventional photographic process as described above to form another image.

The ink sheet comprises a support having a first surface and a second surface, and a heat resistant layer provided on the first surface and provided on the second surface, a releasing layer, a colorant layer and preferably an adhesive layer in that order or a releasing layer, a colorant layer, a metal film layer and an adhesive layer in that order. The resin containing a hydrophilic group is contained in the colorant layer or the adhesive layer according to the ink sheet constitution. The resin is preferably contained in an amount of 30% by weight or more, and more preferably 50% by weight or more in the layer in which it is contained. The metal film layer can make an ink color metallic-colored, and further, a colorant layer containing a yellow colorant can form, as a transfer image, a gold color image which can not be formed in a photographic image.

When the color tone of the image formed by heat fusible thermal transfer ink has the relationships, $L^*\leqq 30$, $-5\leqq a^*\leqq +5$ and $+0.1\leqq b^*\leqq +50$, and glossiness of the image measured according to JIS-Z8741-1983 is 100 or more, a high quality gold image is formed. The metal film layer is practically an aluminum film layer formed by evaporation. Each technique will be explained below.

(Surface layer)

The surface layer is melted or softened during thermal transfer to adhere to a photographic print and has such a function that the heat fusible transfer ink is fixed on the photographic print. Therefore, a thermoplastic resin or an adhesive is used in the layer, and the thermoplastic resin or an adhesive has a hydrophilic group such as a hydroxy group, a carboxy group, a sulfonic acid group, an epoxy group or an amino group. The carboxy, sulfonic acid or amino group may be in the form of salt. The surface layer may further contain a heat fusible compound.

The thermoplastic resin includes a polyamide resin, a polyester resin, a polyacrylate resin (polymethyl methacrylate or polyethyl acrylate), a polyurethane resin, a polyvinyl chloride resin, a polyvinylidene chloride resin, a polystyrene resin, a polyvinyl acetate resin, a polyethylene resin, a polypropylene resin, a polybutadiene resin, a polyvinyl alcohol resin, a phenol resin, a cellulose resin, (methylcellulose, ethylcellulose, carboxymethylcellulose or nitrocellulose), a polyvinyl ether resin, a polyvinyl pyrrolidone resin, a petroleum resin, a rosin resin, a cumarine-indene resin, a terpene resin, a styrene-butadiene rubber and an isoprene rubber. The resin may be used singly or in combination.

The adhesive includes a low molecular weight polyethylene, a rosin resin, a terpene resin and a low molecular weight resin such as an aliphatic, aromatic or dicyclopentadiene petroleum resin.

The heat fusible compound includes carnauba wax, montan wax, bee wax, rice wax, paraffin wax, microcrystalline wax, polyethylene wax, sazol wax and lanolin wax, paraffin wax. The wax may be used singly or in combination.

The content ratio of the thermoplastic resin, adhesive or heat fusible compound may be any, but it is preferable that the thermoplastic resin content is 30 to 100% by weight, the adhesive content is 0 to 50% by weight, and the heat fusible compound content is 0 to 55% by weight.

(Colorant layer)

The colorant layer may be the surface layer containing a colorant, or the colorant layer may be a layer different from the surface layer as an adhesive layer. When the colorant layer is different from the surface layer, the colorant layer is formed by dispersing a colorant in a composition containing the above thermoplastic resin or adhesive.

The colorant includes inorganic pigment such as titanium dioxide, carbon black, zinc dioxide, Prussian blue, cadmium oxide or a chromate of iron oxide, lead, barium, zinc or calcium, organic pigment such as an azo, thioindigo, anthraquinone, anthanthrone, triphenedioxazine pigment, vat dye pigment, phthalocyanine pigment (for example, copper phthalocyanine or its derivative) or quinacridone pigment, and a dye such as a direct dye, a dispersion dye, an oil-soluble dye or a metal containing oil-soluble dye. The dye having excellent light fastness and minimizing density lowering during storage is preferable.

The colorant content of the colorant layer is preferably 5 to 80% by weight.

(Metal film layer)

The metal film layer can be formed by an evaporation, spattering or ion plating method employing zinc, aluminum, gallium, indium, tin, silver, gold, copper, silicon, chromium, titanium, platinum, or vanadium. The thickness of the metal film layer is preferably 10 to 20 nm.

(Releasing layer)

A releasing layer is provided so that only heated portions of the ink layer can be effectively transferred with appropriate sensitivity and sharpens of the transferred image is improved. In the releasing layer, natural wax, paraffin wax, microcrystalline wax, oxidized wax, ester wax, or a low molecular polyethylene wax is used and a high melting point polyethylene wax is especially preferable.

In order to adjust adherence of the releasing layer to the support, the releasing layer may contain a resin or an additive.

(Support)

The support is not specifically limited, and a support of various kinds of material, various layer constitutions or various size is optionally used according to its usage. The support includes a paper sheet such as paper, a coat paper or a synthetic paper (for example, a polypropylene sheet, a polystyrene sheet or their lamination sheet), a polyvinyl chloride sheet, an ABS resin sheet, a polyethylene terephthalate film, a polybutylene terephthalate film, a polyethylene naphthalate film, a polyarylate film, a polycarbonate film, polyether ketone film, a polysulfone film, a polyimide film or their lamination film, a metal film or sheet, a ceramic film or sheet and a complex film in which two or more of the above described sheet or film are laminated.

The thickness of the support is preferably 20 $\mu$m or less, and more preferably 2 to 10 $\mu$m.

A heat resistant layer is provided on the surface (rear surface) of a support opposite the ink layer in order to prevent adherence of a thermal head to the support, sticking, blocking, or crumple occurrence of the ink sheet. The heat resistant layer can be formed with a well-known composition capable of minimizing the sticking described above. The heat resistant layer can be formed with a resin, for example, a resin selected from the group consisting of a silicone resin, a polyester resin, a polyamide resin, a cellulose resin, an acryl resin and a fluorine-containing resin.

In the heat fusible thermal transfer ink image formed, according to the method of the invention, on an image bearing layer of a photographic print having a support and provided thereon, the image bearing layer, a 1 kg/cm$^2$ load was applied to the surface of the support opposite the image bearing layer, and the image bearing layer surface was rubbed at a speed of 200 mm/second for 50 back and forth cycles, where each cycle consisted of one backward stroke and an equal forward stroke. The resulting transfer ink image exhibited no density lowering nor image bleeding on the image periphery, and resulted in an image with excellent durability.

Glossiness of gold images according to the heat fusible thermal transfer ink is preferably 100 or more, more preferably 150 or more, and still more preferably 150 to 500. Regarding color tone, an L* value is preferably 30 or less, and more preferably 20 or less, an a* value is preferably −3 to +3, and a b* value is preferably +0.5 to +30. Glossiness herein referred to is measured according to JIS-Z8741-1983 and is a 45° surface glossiness obtained by the following method:

The 5 cm$^2$ thermal transfer ink solid image is further printed on an image bearing layer of a developed photographic print, and glossiness of the solid image is measured at an incident angle of 45° and at an acceptance angle of 45° using a glossmeter VGS-ID made by Nihon Denshoku Kogyo Co., Ltd.

L*, a* and b* in the invention is an coordinate space represented by the CIE coordinate which was defined in Commission Internationale de l'Eclairage (CIE). Color is represented by lightness, chroma and hue in the CIE coordinate.

Glossiness in the invention can be adjusted by the kinds of metal raw materials for forming a gold image, an evaporation condition for forming a metal film layer, a metal film layer thickness or the surface property of a layer in contact with the bottom surface of the metal film layer.

L*, a* and b* in the invention can be adjusted by the kinds or content of a yellow dye contained in the colorant layer, the colorant layer thickness or metal film layer properties such as metal evaporation conditions and metal film layer thickness.

The present invention will be explained in detail by the following examples, but it is not limited thereto.

EXAMPLE 1

(Preparation of ink sheet 1)

As is shown in FIG. 1, a releasing layer 4, a colorant layer 3, a metal film layer 2 and an adhesive layer 1, each having the following composition, were provided in that order on a 5.0 $\mu$m polyethylene terephthalate (PET) support 5 having a 0.2 $\mu$m heat resistant layer 6 on the surface opposite the colorant layer. Thus, ink sheet 1 was prepared.

| <Releasing layer 4 composition> | |
|---|---|
| High melting point polyethylene wax (Microflat CE-150, made by Koyo Kagaku Co., Ltd.) | 90 weight % |

-continued

| <Releasing layer 4 composition> | |
|---|---|
| Ethylene-vinyl acetate copolymer (Evaflex EV-210, made by Mitsui Dupont Polychemical Co., Ltd.) | 10 weight % |

The thickness of releasing layer was 0.4 μm.

| <Colorant layer 3 composition> | |
|---|---|
| Yellow dye (Eisen Spilon Yellow GRH, made by Hodogaya Kagaku Co., Ltd.) | 10 weight % |
| Acryl resin (Dianal BR-87, made by Mitsubishi Rayon Co., Ltd.) | 80 weight % |
| Rosin resin (Hariester DS-90, made by Harima Kasei Co., Ltd.) | 5 weight % |
| Ethylene-vinyl acetate copolymer (Sorlex R-DH, made by Nihon Gosei kagaku Co., Ltd.) | 5 weight % |

The thickness of Colorant layer 3 was 1.0 μm.

| <Metal film layer 2 composition> |
|---|
| Evaporation aluminum |

The thickness of metal film layer 2 was 500 Å.

| <Adhesive layer 1 composition> | |
|---|---|
| Acrylate copolymer (having a carboxy group) (Julimer AT-510, made by Nihon Junyaku Co., Ltd.) | 50 weight % |
| Polyvinyl chloride resin (G-351, made by Nihon Zeon Co., Ltd.) | 50 weight % |

The thickness of adhesive layer 1 was 0.2 μm.

(Preparation of ink sheet 2)

Ink sheet 2 was prepared in the same manner as in Ink sheet 1, except that the adhesive layer 1 composition was replaced with the following adhesive layer composition:

| | |
|---|---|
| Acrylate copolymer (as described above) | 30 weight % |
| Polyvinyl chloride resin (as described above) | 70 weight % |

(Preparation of ink sheet 3)

Ink sheet 3 was prepared in the same manner as in Ink sheet 1, except that the adhesive layer 1 composition was replaced with the adhesive layer 1 composition was replaced with the following adhesive layer composition:

| | |
|---|---|
| Acrylate copolymer (as described above) | 20 weight % |
| Polyvinyl chloride resin (as described above) | 80 weight % |

(Preparation of ink sheet 4)

Ink sheet 4 was prepared in the same manner as in Ink sheet 1, except that the adhesive layer 1 composition was replaced with an acryl resin having no hydrophilic group (Dianal BR-90, made by Mitsubishi Rayon Co., Ltd.).

(Preparation of light sensitive material sample 1)

As a support was used a paper substrate having a polyethylene layer and a titanium dioxide containing polyethylene layer on the surface of the support opposite the former polyethylene layer. The following compositions were provided in the order described below on the titanium dioxide containing polyethylene layer. Thus, light sensitive material sample 1 was prepared. Gelatin used was a lime-processed gelatin made from cow bone, the gelatin having a calcium content of 20000 ppm and being $\Delta\alpha$=45.

In the following, the numerical value shows an adding amount, g/m$^2$, and the added amount of the silver halide emulsion is illustrated in terms of silver.

| | |
|---|---|
| <Blue sensitive layer> | |
| Gelatin | 1.20 |
| Blue sensitive silver bromochloride emulsion | 0.26 |
| Yellow coupler (Y-1) | 0.80 |
| Dye image stabilizer (ST-1) | 0.30 |
| Dye image stabilizer (ST-2) | 0.20 |
| Anti-stain agent (HQ-1) | 0.02 |
| Anti-irradiation agent (AIY-1) | 0.01 |
| Dinonyl phthalate | 0.20 |
| <Intermediate layer> | |
| Gelatin | 1.20 |
| Anti-stain agent (HQ-2) | 0.12 |
| Diisodecyl phthalate | 0.15 |
| <Green sensitive layer> | |
| Gelatin | 1.40 |
| Green sensitive silver bromochloride emulsion | 0.17 |
| Magenta coupler (MM-1) | 0.35 |
| Dye image stabilizer (ST-3) | 0.15 |
| Dye image stabilizer (ST-4) | 0.15 |
| Dye image stabilizer (ST-5) | 0.15 |
| Anti-irradiation agent (AIM-1) | 0.01 |
| Dinonyl phthalate | 0.20 |
| <UV absorbing layer> | |
| Gelatin | 0.94 |
| UV absorber (UV-1) | 0.28 |
| UV absorber (UV-2) | 0.09 |
| UV absorber (UV-3) | 0.38 |
| Anti-stain Agent (HQ-1) | 0.03 |
| Dinonyl phthalate | 0.40 |
| <Red sensitive layer> | |
| Gelatin | 1.30 |
| Red sensitive silver bromochloride emulsion | 0.21 |
| Cyan coupler (C-1) | 0.24 |
| Cyan coupler (C-2) | 0.08 |
| Dye image stabilizer (ST-1) | 0.20 |
| Anti-stain agent (HQ-1) | 0.01 |
| High boiling point solvent (HBS-1) | 0.20 |
| Dioctyl phthalate | 0.20 |
| <UV absorbing layer> | |
| Gelatin | 0.40 |
| UV absorber (UV-1) | 0.10 |
| UV absorber (UV-2) | 0.04 |
| UV absorber (UV-3) | 0.16 |
| Anti-stain Agent (HQ-1) | 0.01 |
| Anti-irradiation agent (AIC-1) | 0.02 |
| Dinonyl phthalate | 0.20 |
| Polyvinyl pyrrolidone | 0.03 |
| <Protective layer> | |
| Gelatin | 1.00 |

The calcium content of the above obtained sample 1 was 15.0 g/m$^2$.

Y-1
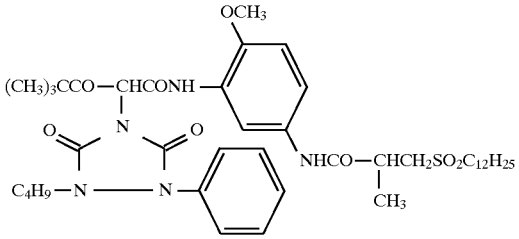
MM-1
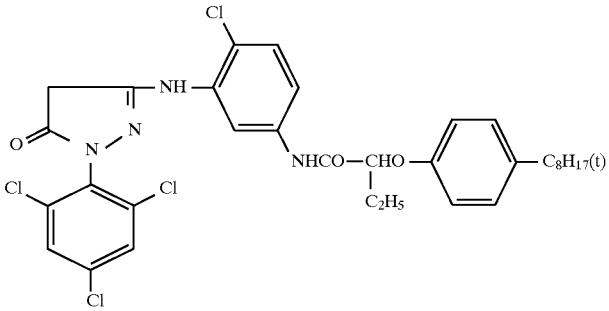
C-1
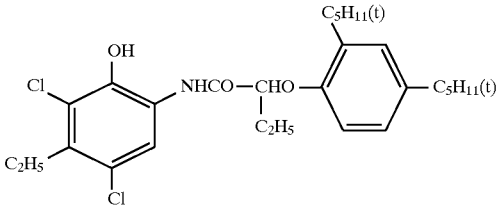
C-2
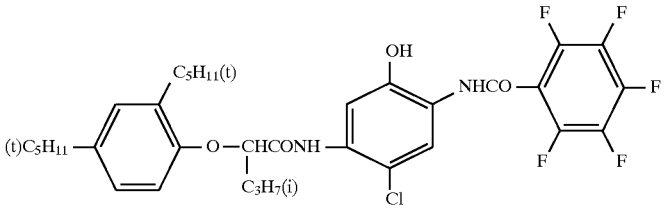
ST-1
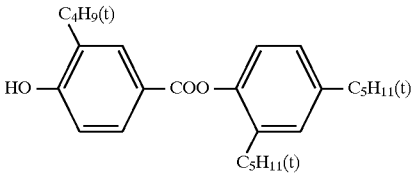
ST-2
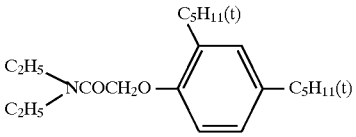
ST-3
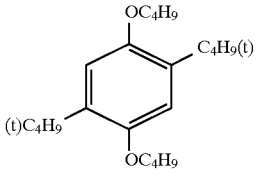
ST-4
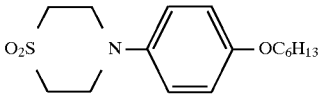

-continued
ST-5
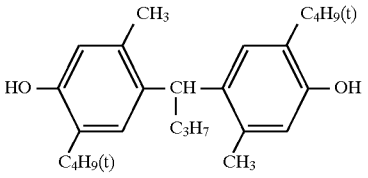
HQ-1
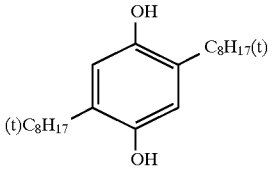
HQ-2
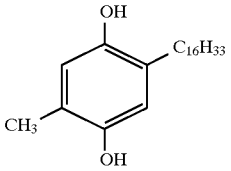
UV-1
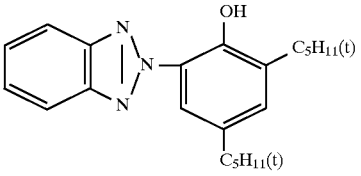
UV-2
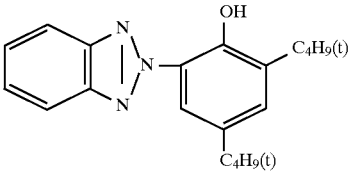
UV-3
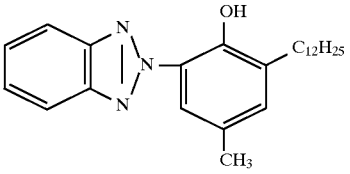
HBS-1
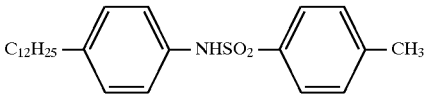
AIY-1
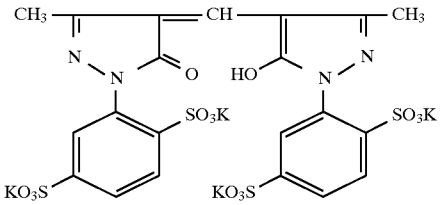
AIM-1
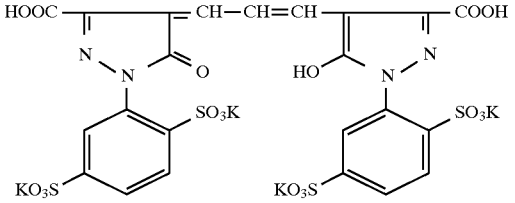

-continued

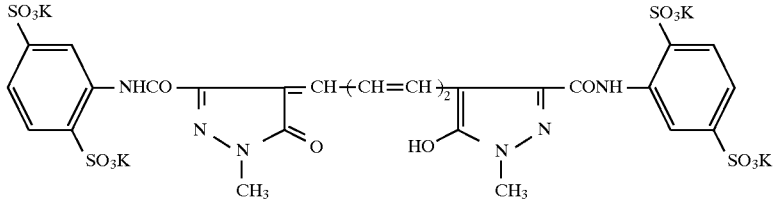

AIC-1

(Preparation of light sensitive material sample 2)

Light sensitive material sample 2 was prepared in the same manner as in light sensitive material sample 1, except that a lime-processed gelatin made from cow bone, the gelatin having a calcium content of 800 ppm and being $\Delta\alpha$=54, was used. The calcium content of the above obtained sample 2 was 6.0 g/m$^2$.

(Forming an image)

Figure 2:
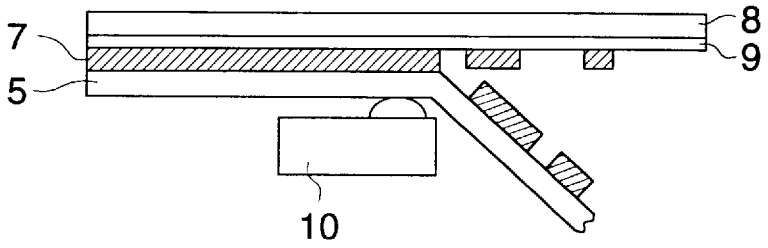
FIG. 2 shows a thermal transfer image forming process used in the invention.
Figure 3:
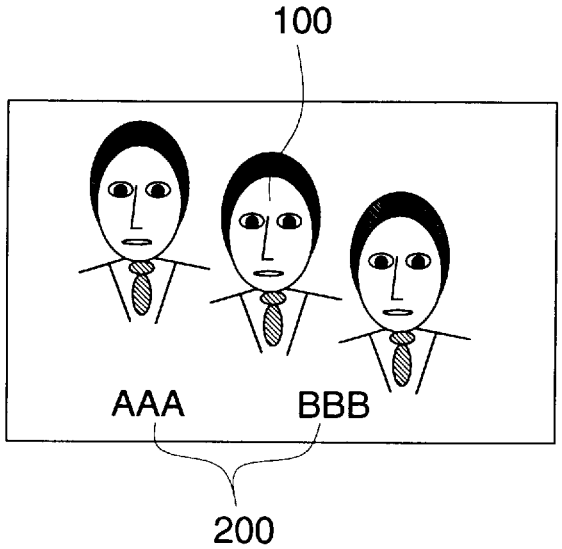
FIG. 3 shows one embodiment of an image bearing element obtained by the image forming method of the invention.

The above obtained light sensitive material samples 1 and 2 were exposed and developed to obtain a print having a portrait. As illustrated in FIG. 2, the resulting print having portrait layer 9 on the support 8 was superposed on an ink sheet having ink 7 on an ink sheet support 5 so that the portrait layer 9 contacted the ink 7 of the ink sheet. Thereafter, a thermal head 10 was applied at 400 DPI to the ink sheet support 5 of the superposed material to transfer ink 7 to the portrait layer 9 and print a thermal transfer character image. Thus, a photographic portrait image 100 and a thermal transfer character image 200 were formed as shown in FIG. 3.

Evaluation of Heat Fusible Thermal Transfer Image (1) printed character image quality:

The printed character image was observed by a 20 power magnifier and evaluated in five evaluation stages from (5) giving an excellent image to (1) in which the nearest two one-dot lines are not resolved.

(2) An L* value, an a* value and a b* value were measured through a color difference meter CR-221 made by Minolta Co., Ltd. Further, glossiness was measured according to the above described method. As a result, the heat fusible thermal transfer character image obtained using ink sheets 1 through 4 had an L* value of 6.5, an a* value of 0.5, a b* value of 4.0 and a glossiness of 160, which showed a gold image with high quality.

(3) Rubbing test:

A 1 cm$^2$ print paper QA-A6 (made by Konica Corporation) was superposed on the heat fusible thermal transfer character image, which had been obtained using each sample obtained above, in such a manner that the rear surface of the print paper (the surface of the support opposite the silver halide photographic light sensitive layer) contacted the character image. Thereafter, a load of 1 kg was applied to the 1 cm$^2$ print paper and rubbed for 500 cycles, where each cycle consisted of one 50 mm left stroke and an equal right stroke. The resulting transfer image was observed and evaluated in five evaluation stages from (5) providing no density lowering nor image bleeding to (1) providing marked density lowering or image bleeding.

The results are shown in the following:

| | Light sensitive material sample 1 | | Light sensitive material sample 2 | |
|---|---|---|---|---|
| | Printed character quality | Rubbing property | Printed character quality | Rubbing property |
| Ink sheet 1 | 3 | 3 | 5 | 5 |
| Ink sheet 2 | 3 | 3 | 4 | 4 |
| Ink sheet 3 | 2 | 1 | 2 | 2 |
| Ink sheet 4 | 1 | 1 | 1 | 1 |

As is apparent from the above Table, ink sheets (ink sheets 1 through 4) having a surface layer of ink containing a resin having a hydrophilic group provided a heat fusible thermal transfer image is superior in image quality and image durability to ink sheet (ink sheet 5) having a surface layer of ink containing a resin having no hydrophilic group. Further, ink sheets (ink sheets 1 through 3) having a surface layer of ink containing, in an amount of 30% by weight or more, a resin having a hydrophilic group provide more excellent results in image quality and image durability as compared to ink sheet (ink sheet 4) having a surface layer of ink containing, in an amount of 20% by weight, a resin having a hydrophilic group.

What is claimed is:

1. A method for forming an image comprising the steps of:

providing a first image formed photographic material which has been imagewise exposed and developed according to a conventional photographic process employing a silver halide photographic light sensitive material comprising a first reflective support and provided thereon, a photographic component layer comprising a silver halide emulsion layer;

imagewise heating ink of a heat fusible thermal transfer ink sheet comprising a second support and provided thereon, the ink; and imagewise transferring the heated ink onto the first image to form a second image, wherein the surface layer of the ink contacting the layer having the first image contains a resin having a hydrophilic group, the color tone of the second image has the relationships in the CIE coordinate, L*<30, −5<a*<+5 and +0.1<b*<+50, and glossiness measured according to JIS-Z8741-1983 is from 100 to 500.

2. The method of claim 1, wherein the resin content of the surface layer is from 30% to 100% by weight.

3. The method of claim 1, wherein the ink sheet has a releasing layer, a colorant layer, a metal film layer and an adhesive layer in that order on the second support.

4. The method of claim 3, wherein the colorant layer contains a yellow colorant and the metal film layer is an aluminum film layer formed by evaporation.

5. The method of claim 1, wherein the photographic component layer has a calcium content of from 0 to 10 mg/m$^2$.

6. The method of claim 1, wherein an outermost layer of the photographic component layer contains gelatin having a difference of from 50 to 100 between its specific rotation at 20° C. and its specific rotation at 40° C.

7. The method of claim 1, wherein said imagewise heating and said imagewise transferring is carried out employing a thermal head.

8. The method of claim 3, wherein the resin content of the layer is from 30% to 100% by weight;

the photographic component layer has a calcium content of 0 to 10 g/m$^2$ and an outermost layer of the photographic component layer contains a gelatin having a difference of 50 or more its specific rotation of 20° C. and its specific rotation at 40° C.

9. The method of claim 8, wherein the colorant layer contains a yellow colorant and the metal film layer is an aluminum film layer formed by evaporation.

10. The method of claim 9, wherein said imagewise heating and said imagewise transferring is carried out employing a thermal head.

11. The method of claim 8, wherein said imagewise heating said imagewise transferring is carried out employing a thermal head.

12. The method of claim 8, wherein the calcium content is from 0 to 5 mg/m$^2$.

13. The method of claim 5, wherein the calcium content is from 0 to 5 mg/m$^2$.

* * * * *